US007186015B2

(12) United States Patent
Kimmet et al.

(10) Patent No.: US 7,186,015 B2
(45) Date of Patent: Mar. 6, 2007

(54) BACKLIGHT DISPLAY SYSTEM

(75) Inventors: Mark A. Kimmet, Knoxville, TN (US); Troy T. Bachman, Knoxville, TN (US)

(73) Assignee: Polymore Circuit Technologies, Inc., Maryville, TN (US)

( * ) Notice: Subject to any disclaimer, the term of this patent is extended or adjusted under 35 U.S.C. 154(b) by 39 days.

(21) Appl. No.: 10/826,831

(22) Filed: Apr. 16, 2004

(65) Prior Publication Data

US 2005/0231935 A1 Oct. 20, 2005

(51) Int. Cl.
*F21V 7/04* (2006.01)

(52) U.S. Cl. ..... 362/630; 362/629

(58) Field of Classification Search ..... 362/269, 362/629

See application file for complete search history.

(56) References Cited

U.S. PATENT DOCUMENTS 3,748,455 A 7/1973 Welton
4,081,601 A 3/1978 Dinella et al.
4,602,448 A 7/1986 Grove
4,714,983 A * 12/1987 Lang ..... 362/27
5,019,944 A 5/1991 Ishii et al.
5,162,950 A 11/1992 Suman et al.
5,822,053 A * 10/1998 Thrailkill ..... 362/11
6,052,224 A * 4/2000 Richardson ..... 359/398
6,411,353 B1 * 6/2002 Yarita et al. ..... 349/59
6,491,412 B1 * 12/2002 Bowman et al. ..... 362/249
6,655,810 B2 * 12/2003 Hayashi et al. ..... 362/600
2003/0063477 A1 * 4/2003 Stepanenko et al. ..... 362/546

* cited by examiner

*Primary Examiner*—Ali Alavi
*Assistant Examiner*—William J Carter
(74) *Attorney, Agent, or Firm*—Pitts & Brittian, PC

(57) ABSTRACT

An apparatus and method for backlighting a translucent image. At least one polymer thick film conductive strip is applied to a glass substrate, connecting a plurality of light emitting devices, a dropping resistor, and a power supply connection. The glass substrate is positioned behind a translucent image that is backlit by the light emitting devices. The method includes applying a conductive polymer thick film ink to a substrate to form conductive traces, applying at least one light emitting device to the substrate, applying a dropping resistor to the substrate, and curing the ink.

27 Claims, 3 Drawing Sheets

BACKLIGHT DISPLAY SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to backlighting translucent images. More particularly, this invention pertains to apparatus and methods for integrating a lighting circuit on a glass substrate to provide backlight illumination of a transparent and/or translucent image.

2. Description of the Related Art

The use of fluorescent light to backlight or illuminate a color transparency is well known in the art. In a typical embodiment, fluorescent bulbs are placed within a box having a glass front panel to which a color transparency is secured. Typically, such an arrangement requires that the box containing the fluorescent bulbs be deep enough to prevent the bulbs from forming hotspots or brighter areas on the transparency.

Various patents have issued with respect to backlighting images. For example, U.S. Pat. No. 3,748,455, titled "Display Apparatus," issued to Welton on Jul. 24, 1973, discloses a portable display apparatus for exhibiting at a trade show. The Welton device includes a light box having a removable translucent or transparent panel and folding doors or panels, which make the light box self-supporting. An improvement of the Welton device is disclosed in U.S. Pat. No. 4,602,448, titled "Lighted display panel system," issued to Grove on Jul. 29, 1986. The Grove patent discloses a lighted display panel system that distributes fluorescent light through a lens over the lamps, thereby reducing the depth of the light box and avoiding hot spots.

As seen by the above identified patents, it is often quite useful to be able to place a light source on or very close to the surface of a glass substrate. Such applications include mounting lights in the vicinity of vanity mirrors for use in automobile visors. For example, U.S. Pat. No. 5,162,950, titled "Lighted Mirror Assembly for Motor Vehicle Visor," and issued to Suman, et al., on Nov. 10, 1992, discloses an illuminated vanity mirror assembly with a resistor screen-printed on a polymeric film substrate glued to the back face of the mirror.

Various apparatus and methods for integrating electrical circuitry onto a substrate are known. Additionally, various techniques are known for making electrical connections to components mounted on the substrate. For example, U.S. Pat. No. 4,081,601, titled "Bonding Contact Members to Circuit Boards," issued to Dinella, et al., on Mar. 28, 1978, discloses a conductive overlay solder-bonded over a contact finger top surface area and having a gold surface layer. U.S. Pat. No. 5,019,944, titled "Mounting Substrate and Its Production Method, and Printed Wiring Board Having Connector Function and Its Connection Method," issued to Ishii, et al., on May 28, 1991, discloses using metal nodules and adhesive to make electrical contact and to mount components to a substrate.

BRIEF SUMMARY OF THE INVENTION

Apparatus and methods for backlighting a transparent and/or translucent image are provided. According to one embodiment of the present invention, at least one polymer thick film conductive strip is applied to a glass substrate, connecting at least one light emitting device, a dropping resistor, if required, and a power supply connection. The glass substrate is position behind a translucent image that is illuminated by the light emitting devices. A back board is behind the glass substrate. The back board has a reflector facing the glass substrate and a plurality of spacers for separating the back board from the glass substrate. In one embodiment, light barriers are positioned between the back board and the glass substrate. In another embodiment, a frame encloses a sheet with the translucent image, the glass substrate, and the back board.

The method of fabricating the glass substrate with the electrical circuit on one surface, in one embodiment, includes the steps of preparing the substrate, applying and curing an opaque border with thermosetting paint to one side of the substrate, applying at least one conductive trace to a specified area of the one surface of the substrate, applying a component adhesive to the substrate, applying the electrical components of the substrate, and curing the circuit on the substrate.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for backlighting a transparent and/or translucent image is disclosed. Although the illustrated embodiment of FIG. 1 shows a frame 102, such as a common picture frame, the backlight image system 10 is suitable for other applications in which an object is illuminated from the rear.

Figure 1:
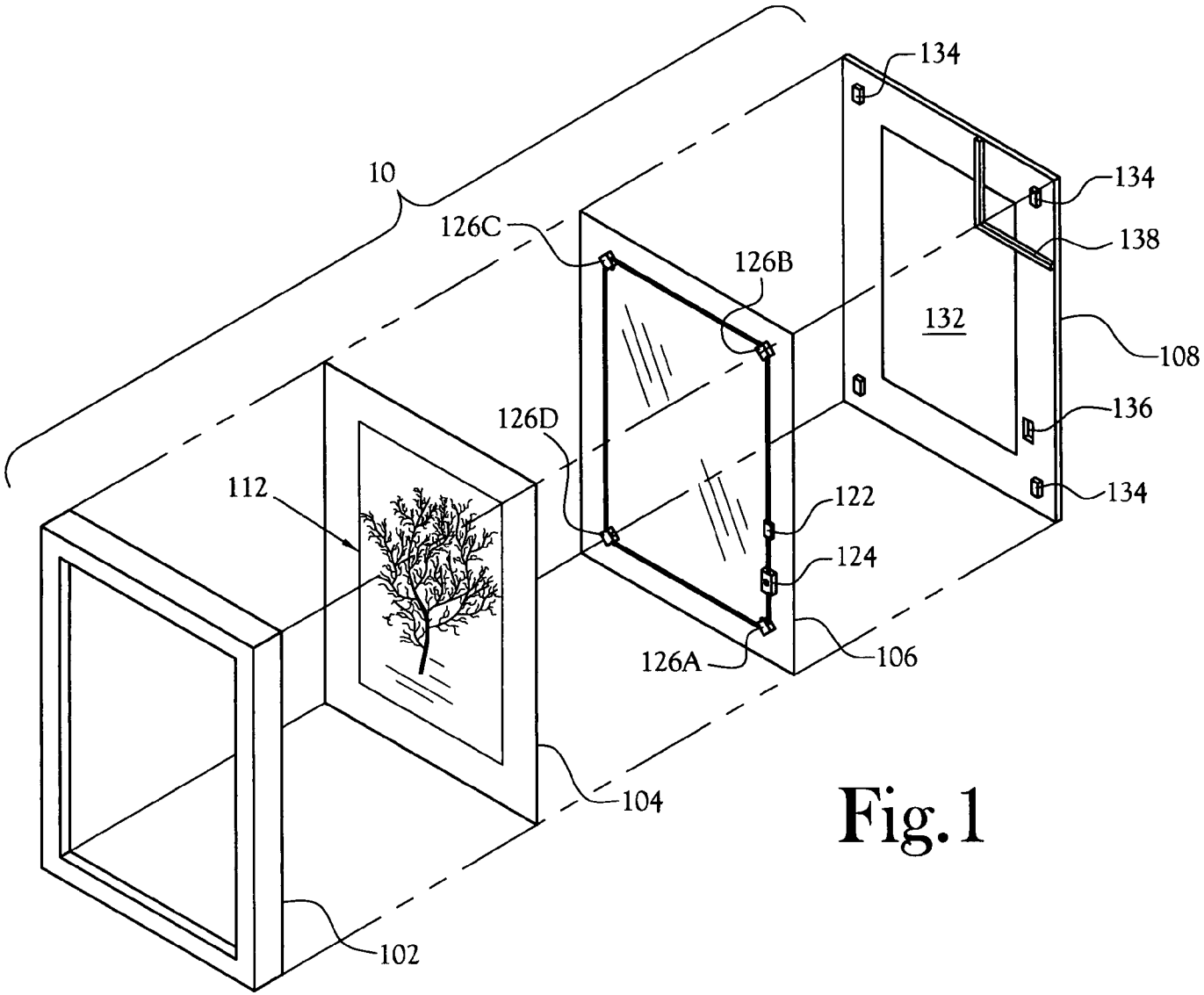
FIG. 1 is an exploded view of one embodiment of the present invention.

FIG. 1 illustrates a backlight image system 10 in an exploded view. A translucent sheet 104 is adapted to be inserted in a frame 102. Behind the translucent sheet 104 is a glass plate 106. Behind the glass plate 106 is a back board 108, which is separated from the glass plate by standoffs, or spacers, 134. In another embodiment, the frame 102 is constructed such that separate spacers 134 are not required because the frame 102 provides for supporting the glass plate 106 away from the back board 108.

The translucent sheet 104 has an image 112 printed or otherwise affixed to the sheet 104. In one embodiment, the translucent sheet 104 is a backlight film having a glossy finish on the front and a matte finish on the back upon which the image is printed in reverse. In the illustrated embodiment, the area taken by the image 112 is less than the full area of the sheet 104 to allow for the backlighting and the border created by the frame 102. The image 112 is any graphic or other image. In various embodiments, the image 112 is formed by printing on the surface of the translucent sheet 104 with an ink jet or laser printer. In another embodiment, the translucent sheet 104 has multiple images 112 and the sheet 104 scrolls such that each image 112 is illuminated in turn.

In another embodiment, the translucent sheet 104 is a transparency film with an image 112 on one surface. In still another embodiment, the translucent sheet 104 is a cloth or fabric. In various other embodiments, other materials that produce an effect when illuminated from the rear are used in place of the translucent sheet 104.

The back board 108 is a stiff board upon which one surface a reflector 132 is formed. In one embodiment, the reflector 132 is a white surface surrounded by a black surface on the back board 108. In another embodiment, the reflector 132 is a mirrored surface. The reflector 132 is sized to match the opening bounded by the light emitting devices 126 on the glass plate 106. The black border on the back board 108 reduces the occurrence of hotspots.

The back board 108 includes an opening 136 through which the power connector 124 is accessible. In the illustrated embodiment, the back board 108 includes a plurality of spacers 134. The spacers 134 are positioned so as not to interfere with the light emitting devices 126, either by coming into contact with the light emitting devices 126 or by obstructing the light emitting devices' 126 emitted light path. In one embodiment, the spacers 134 are a resilient material that secure the glass plate 106 in the frame 102. In various embodiments, the spacers 134 are formed of foam, rubber, or other resilient or compressible material. In another embodiment, the spacers 134 are spring-type devices that function to separate the back plate 108 from the glass plate 106 and to secure the glass plate 106 in the frame 102. In still another embodiment, the frame 102 is constructed in such a manner as to secure the glass plate 106 at the front of the frame 102 and to secure the back plate 108 at the back of the frame 102. In one embodiment, the frame 102 includes protruding tabs to secure the glass plate 106 and the back plate 108.

In one embodiment, the light emitting devices 126 are light emitting diodes (LEDs). In another embodiment, the light emitting devices 126 are incandescent lamps. As used herein, light emitting devices 126 includes both LEDs, incandescent lamps, and other sources of electrically driven illumination.

Figure 2:
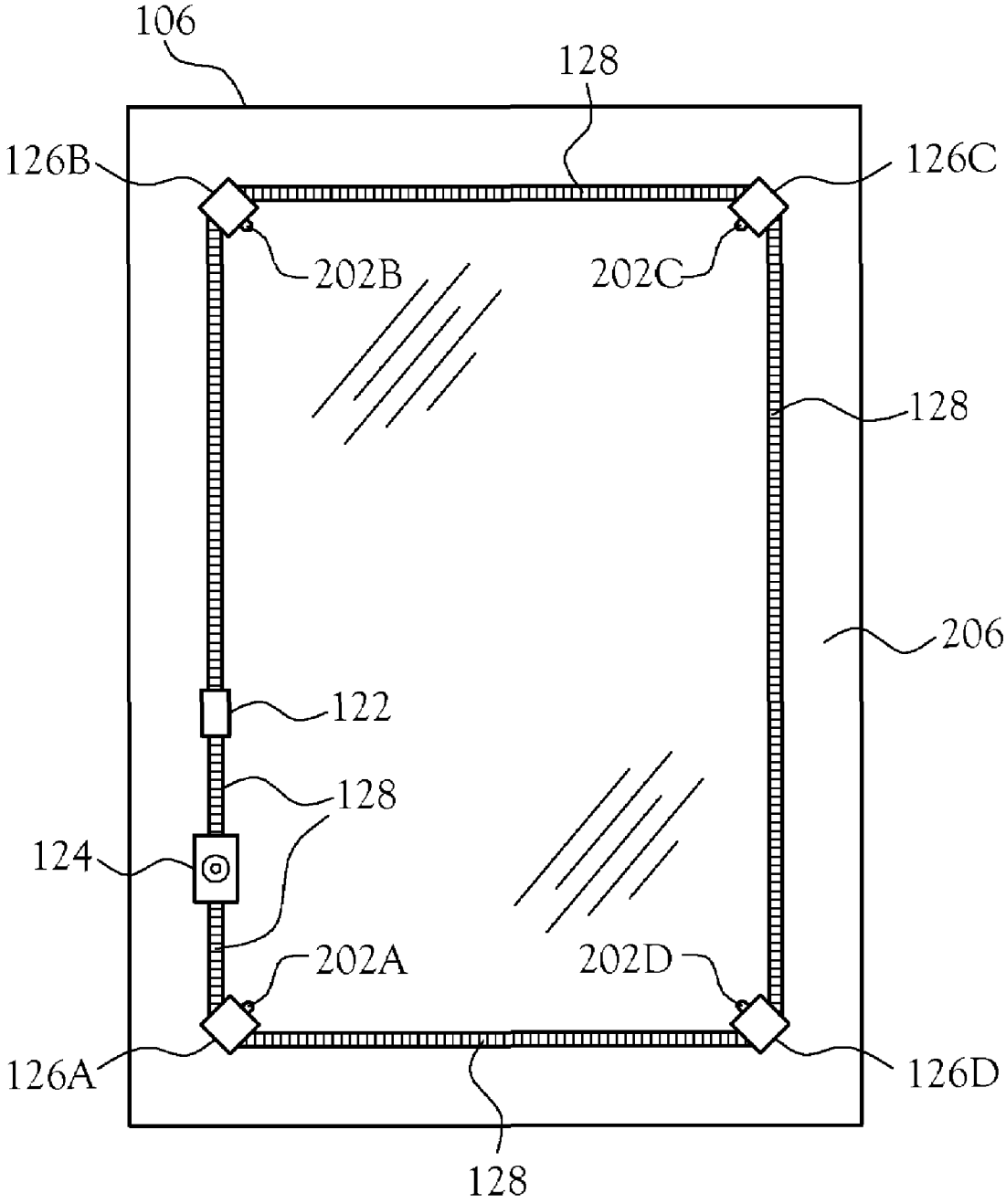
FIG. 2 is a plan view of one embodiment of the glass plate.

FIG. 2 illustrates the back surface of the glass plate 106. The glass plate 106 is a transparent sheet of glass that is positioned behind the transparent and/or translucent sheet 104. In another embodiment, the plate 106 is formed of a material other than glass. The material being suitable for holding the illumination circuit to its surface. In the illustrated embodiment, the plate 106 is transparent. In another embodiment, selected portions of the plate 106 are coated with an opaque material, thereby preventing the transfer of light from the light sources 126 to the transparent and/or translucent sheet 104 in the selected portions.

In the illustrated embodiment, a coaxial power connecter receptacle 124 is electrically connected to conductor traces 128 on the glass plate 106, which is a substrate to which the illumination circuit is attached. The conductor traces 128 form conductors that connect the various electrical components 124, 122, 126 mounted on the glass plate 106. The conductor traces 128 are formed by applying a conductive polymer thick film ink with specified properties to the glass plate 106. Generally, polymer thick film inks are screen printable resins that include conductive fillers, such as silver, copper, and other conductive materials (for a conductive polymer thick film ink), resistive fillers, such as carbon, (for a resistive polymer thick film ink), or no fillers (for an insulating polymer thick film ink). The properties of the polymer thick film ink include, but are not limited to, electrical conductivity. Typically, these properties are varied by changing the materials in the ink. For example, the conductive traces 128 require high electrical conductivity; therefore, an ink with copper, silver, or other conductive material is used, with silver producing an ink with higher electrical conductivity than copper.

Polymer thick film ink has other properties, including viscosity, which determine the method of application. Selecting the viscosity and other properties for a particular method of application is known in the art. Those skilled in the art will recognize that any of various conductive inks can be used without departing from the spirit and scope of the present invention.

In the illustrated embodiment, the circuit formed by the conductor traces 128 connects the power connector to a dropping resistor 122 and to the four LEDs 126A, 126B, 126C, 126D. The dropping resistor 122 serves to limit the current flowing through the LEDs 126. In one embodiment, the dropping resistor 122 is a surface mount resistor electrically connected to the conductor traces 128. In another embodiment, an ink with carbon is used for the resistor 122. In this embodiment, instead of using a surface mount resistor, a strip of resistive polymer thick film ink is used. The electrical conductivity, or inversely, the resistivity, of the ink is controlled by adjusting the amount of conductive material in the ink. The resistive strip 122 requires a lower electrical conductivity than the conductive traces 128; therefore, an ink with carbon is used, with the amount of carbon used controlling the conductivity. In this embodiment, the resistive ink is a low-ohm carbon ink.

In the illustrated embodiment, the light emitting devices 126 are positioned in the corners of the glass plate 106 with the light emitting portion 202 aimed toward the center of the glass plate 128 with the radiating axis of the light being parallel to the glass plate 106. In another embodiment, the light emitting devices 126 are located at places other than the corners of the glass plate 106, thereby producing special effects on the image 112. In one embodiment, the light emitting devices 126 are high intensity white light emitting devices. In other embodiments, one or more of the light emitting devices 126 emit a colored light and/or are multi-colored light emitting devices. In this application, light emitting diodes have the advantage of consuming little power for the amount of illumination provided, as compared to conventional incandescent lamps. However, it should be understood that the advantage has little significance when an external power supply 302 is used. Incandescent lamps are readily available in small packages with high intensity white light. In another embodiment, the light emitting devices 126 are incandescent lamps.

In one embodiment, a light barrier 138 is positioned normal to the glass plate 106 and between the glass plate 106 and the back sheet 108. FIG. 1 illustrates a light barrier 138 isolating the light emitted from one light emitting device 126B from the other light emitting devices 126A, 126C, 126D. In this embodiment, the isolated light emitting device 126B, if it had an emitted color different than the other light emitting devices 126A, 126C, 126D, would produce a special effect by backlighting the image 112. In other embodiments, the light barrier 138 is positioned to produce other special effects on the image 112 by positioning the barrier 138 so as to produce shadows or to isolate the illumination of one light emitting device 126 from another light emitting device 126. In one embodiment, the barrier 138 has surfaces that reflect the illumination from the light emitting devices 126.

In one embodiment, the LEDs 126A, 126B, 126C, 126D are surface mount super-yellow LEDs with an intensity of 200 mcd at a forward voltage of 2.5 volts and a current of 20 milliamps. In one embodiment, the LEDs 126A, 126B, 126C, 126D are secured to the glass plate 106 with an adhesive. In another embodiment, the dropping resistor 122 is secured to the glass plate 106 with an adhesive. In another embodiment, the power connector 124 is secured to the glass plate 106 with an adhesive. The adhesive provides structural strength to secure the components 122, 124, 126 to the glass plate 106. One such adhesive is Loctite Chipbonder, which is a surface mount adhesive. Other adhesives are also suitable.

In one embodiment, the electrical connection of the components 122, 124, 126 to the conductive trace 128 is accomplished by applying a highly conductive adhesive to join the terminals of the components 122, 124, 126 to the conductive trace 128. In one embodiment, the conductive trace 128 and the conductive adhesive are the same material. The highly conductive adhesive is an electrically conductive silver epoxy such as Elpox as sold by Amepox Microelectronics Ltd. Other adhesives that have a high conductivity are also suitable. In another embodiment, a highly conductive adhesive that is a polymer paste is used as a solder replacement. One such solder replacement is Eko-Solder as sold by Amepox Microelectronics Ltd. Other solder replacements are also suitable. In still another embodiment, termination areas are formed of solder paste applied to an exposed portion of the conductive trace 128. The terminals of the components 122, 124, 126 are placed in conjunction with the termination areas and the solder is re-flowed, thereby forming an electrical connection between the conductive trace 128 and the components 122, 124, 126.

In one embodiment, the conductive traces 128 are printed on one surface of the substrate 106. The components 122, 124, 126 are then placed on land pads formed as part of the conductive traces 128. In another embodiment, additional conductive adhesive is placed on the land pads as necessary and depending on the thickness of the printed conductive trace 128.

Figure 3:
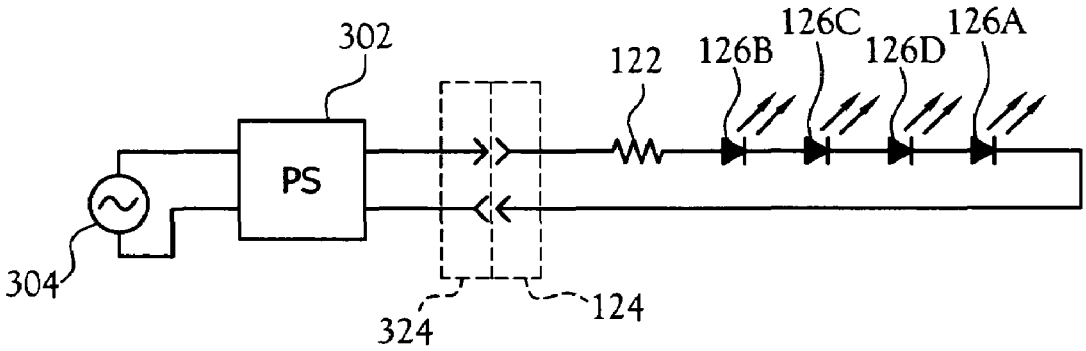
FIG. 3 is a schematic diagram of one embodiment of the present invention.

FIG. 3 illustrates one embodiment of the electrical connections of the backlight image system 10. In this embodiment, a power supply 302 is connected to a power source 304. The power supply 302 converts the voltage of the power source 304 to a DC voltage suitable for supplying power to the four series connected LEDs 126A, 126B, 126C, 126D. The dropping resistor 122 ensures that the current through the LEDs 126 is limited, which in one embodiment is a current of 20 milliamps. The power supply 302 has a cable with a power supply connector 324 that mates to the power connector 124 on the glass plate 106.

Figure 4:
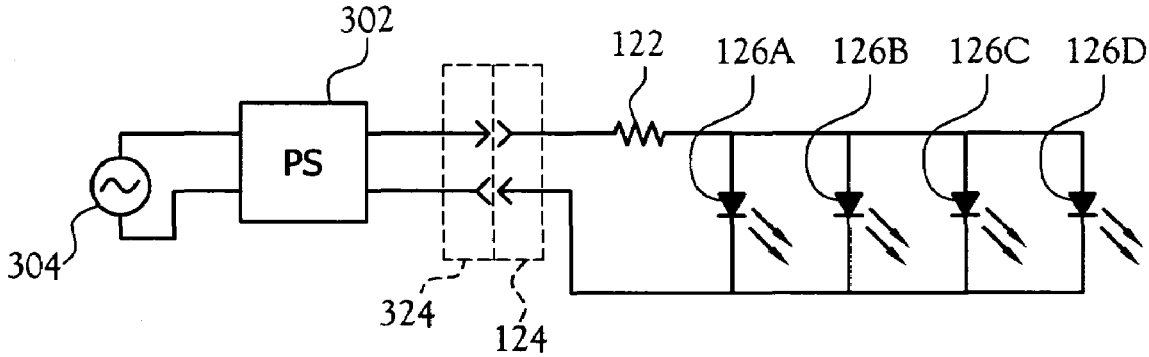
FIG. 4 is a schematic diagram of another embodiment of the present invention.

FIG. 4 illustrates another embodiment of the electrical connections of the backlight image system 10. In this embodiment, the LEDs 126A, 126B, 126C, 126D are parallel connected, again with the dropping resistor 122 ensuring that the current through the LEDs 126 is limited. Those skilled in the art will recognize that the LEDs 126 can be wired with a combination of series and parallel connections without departing from the spirit and scope of the present invention.

Figure 5:
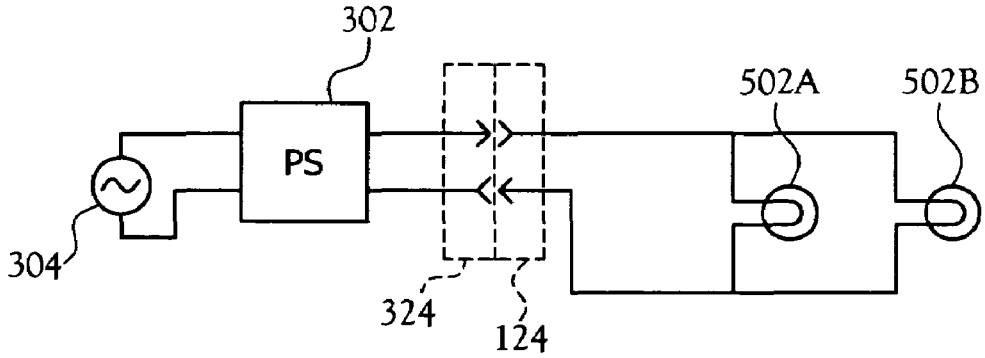
FIG. 5 is a schematic diagram of still another embodiment of the present invention.

FIG. 5 illustrates still another embodiment of the electrical connections of the backlight image system 10. In this embodiment, two incandescent lamps 502A, 502B are wired in parallel to provide illumination. Those skilled in the art will recognize that any number of incandescent lamps 502 in various series-parallel arrangements can be used without departing from the spirit and scope of the present invention.

In another embodiment, the power connector 124 on the glass plate 106 is replaced by a battery holder. In this embodiment, no external power supply 302 is used, but the power source 302 is connected directly to the conductive traces 128 on the glass plate 106. The power source 302 in this embodiment is one or more direct current batteries.

In still another embodiment, the power source 302 is connected directly to the illumination circuit through the power supply connector 324. In this embodiment, the power source 302 is a battery pack containing one or more batteries. The power supply connector 324 of the battery pack 302 is plugged into the power connector 124, thereby powering the illumination circuit.

In various other embodiments, the illumination circuit includes components that vary the illumination provided by the light emitting devices 126, such as by switching selected light emitting devices 126 on and off, by changing the color emitted by multi-colored light emitting devices 126, or by varying the intensity of the light emitting devices 126.

The glass plate 106 with the lighting circuit, in one embodiment, is fabricated by first applying the conductive traces 128 to the glass plate 106. An adhesive is then applied to the glass plate 106 at the locations of the dropping resistor 122, the power connector 124, and the light emitting devices 126. The electrical components 122, 124, 126 are then positioned on the adhesive. The glass plate 106 is then cured in an oven.

In another embodiment, an opaque border 206 is printed around the perimeter of the glass plate 106. The opaque border 206 hides the traces 128 and components 122, 124, 126 from view from the opposite surface of the glass plate 106. The opaque border 206 is formed of an opaque ink, which, in one embodiment, is a thermosetting gloss ink from Sericol. In the embodiment with the border 206, the border 206 is printed and cured before the traces 128 are printed, the components 122, 124, 126, as necessary, are installed. In one embodiment, the opaque border 206 is approximately 1½ inches in from the edge of the glass plate 106. In other embodiments, the opaque border 206 has an inside aperture formed to illuminate all or selected portions of the image 112.

The backlight image system 10 includes various functions. The function of forming an illumination circuit on a substrate is implemented by the conductive traces 128 cured to the plate 106 with the traces 128 electrically connecting the LEDs 126 to the dropping resistor 122, all of which are formed or attached to the plate 106. In another embodiment, the function of forming the illumination circuit is implemented by the conductive traces 128 cured to the plate 106 with the traces 128 electrically connecting the light emitting devices 126, which are incandescent lamps attached to the plate 106.

The function of supplying power to the illumination circuit is implemented, in one embodiment, by the power connector 124 attached to the plate 106 and electrically connected to the conductive traces 128 forming the illumination circuit. In another embodiment, the function of supplying power is implemented by adhering a battery holder to the plate 106 with the electrical connections for the battery holder electrically connected to the conductive traces 128 forming the illumination circuit.

The function of backlighting the image is implemented by the illumination circuit formed on the rear surface of the plate 106 with the transparent or translucent sheet 104 adjacent the opposite surface of the plate 106. In another embodiment, the function of backlighting the image includes the back board 108 with a reflector. In still another embodiment, the function of backlighting the image includes the back board 108 with spacers 134 and a surrounding frame 102 that secures the sheet 104, the plate 106, and the back board 108. The function of blocking a front view of the illumination circuit is implemented by the opaque border 206 applied to the glass plate 106 between the plate 106 and the conductive traces 128. The opaque border 206 hides the conductive traces 128 with their associated land pads and hides the components 122, 124, 126 forming the illumination circuit.

From the foregoing description, it will be recognized by those skilled in the art that a backlight image system 10 has been provided. An illumination circuit is placed on a glass plate 106 positioned behind a translucent sheet 104 or other object to be illuminated. Electrical power is applied to the illumination circuit, thereby powering at least one light emitting device 126 to provide backlight illumination to the image 112. Special effects are produced by using light barriers 138 positioned so as to direct or block the illumination from specified areas of the image 112. Also, special affects are produced by using light emitting devices 126 with varying colors or intensity.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, we claim:

1. An apparatus for providing backlight illumination of an image, said apparatus comprising:

a glass substrate having a front surface and a rear surface, an opaque border adhered to said rear surface, said opaque border having an inside aperture whereby a selected portion of the image is illuminated;

a plurality of conductive traces adhered to said opaque border;

at least one light emitting device adhered to said rear surface, each of said at least one light emitting device in electrical connection with at least a pair of said plurality of conductive traces, said plurality of conductive traces and said at least one light emitting device forming an illumination circuit;

a means for supplying power to said illumination circuit;

a sheet proximal said front surface of said substrate, said sheet including the image to be illuminated; and a back board having a reflector, said back board positioned proximal to and separated from said rear surface of said substrate, said reflector on a surface of said back board proximal said rear surface.

2. The apparatus of claim 1 further including a dropping resistor adhered to said opaque border, wherein said at least one light emitting device includes at least one light emitting diode, said dropping resistor in electrical connection with at least a pair of said plurality of conductive traces, said plurality of conductive traces, said at least one light emitting device, and said dropping resistor forming said illumination circuit.

3. The apparatus of claim 2 wherein said dropping resistor is formed from a resistive polymer thick film ink.

4. The apparatus of claim 2 wherein said dropping resistor is a surface mount component having a selected resistance.

5. The apparatus of claim 1 wherein said plurality of conductive traces are formed of a conductive polymer thick film ink.

6. The apparatus of claim 1 further including a plurality of spacers separating said back board from said rear surface.

7. The apparatus of claim 1 further including a light barrier between said back board and said rear surface.

8. The apparatus of claim 1 further including a frame in which said substrate, said sheet, and said back board are secured, said frame having an opening for viewing the image.

9. The apparatus of claim 1 wherein said means for supplying power includes a power connector adhered to said substrate, said power connector in electrical connection with a pair of said plurality of conductive traces.

10. The apparatus of claim 1 wherein said means for supplying power includes a battery holder adhered to said substrate, said battery holder in electrical connection with a pair of said plurality of conductive traces.

11. An apparatus for providing backlight illumination of an image, said apparatus comprising:

a substrate having a front surface and a rear surface, an opaque border adhered to said rear surface, said opaque border having an inside aperture whereby a selected portion of the image is illuminated, a plurality of conductive traces adhered to said rear surface, said plurality of conductive traces formed of a conductive polymer thick film ink; and at least one light emitting device adhered to said rear surface, each of said at least one light emitting device in electrical connection with at least a pair of said plurality of conductive traces, said plurality of conductive traces and said at least one light emitting device forming an illumination circuit.

12. The apparatus of claim 11 further including a dropping resistor adhered to said opaque border, wherein said at least one light emitting device includes at least one light emitting diode, said dropping resistor in electrical connection with at least a pair of said plurality of conductive traces, and said plurality of conductive traces, said at least one light emitting device, and said dropping resistor forming said illumination circuit.

13. The apparatus of claim 11 wherein said substrate is formed of glass, and said opaque border is positioned between said substrate and said plurality of conductive traces.

14. The apparatus of claim 11 further including a means for supplying power to said illumination circuit.

15. The apparatus of claim 11 further including a power connector adhered to said substrate, said power connector in electrical connection with a pair of said plurality of conductive traces.

16. The apparatus of claim 11 further including a battery holder adhered to said substrate, said battery holder in electrical connection with a pair of said plurality of conductive traces.

17. The apparatus of claim 11 further including a sheet proximal said front surface of said substrate, said sheet including the image to be illuminated.

18. The apparatus of claim 11 further including a back board, said back board positioned proximal to and separated from said rear surface of said substrate.

19. The apparatus of claim 18 further including a plurality of spacers separating said back board from said rear surface.

20. The apparatus of claim 18 further including a reflector on a surface of said back board proximal said rear surface.

21. The apparatus of claim 18 further including a light barrier between said back board and said rear surface.

22. The apparatus of claim 11 further including a sheet proximal said front surface of said substrate, said sheet having the image to be illuminated and a back board having a reflector, said back board positioned proximal to and separated from said rear surface of said substrate.

23. The apparatus of claim 22 further including a frame in which said substrate, said sheet, and said back board are secured, said frame having an opening for viewing the image.

24. A method of providing backlight illumination of an image with an illumination circuit formed on a substrate, said method comprising the steps of:

(a) applying an opaque border to said surface of the substrate;

(b) applying a conductive polymer thick film ink to a plurality of selected portions of a surface of the substrate, said conductive polymer thick film ink forming a plurality of conductive traces;

(c) applying a dropping resistor to said substrate, said dropping resistor positioned such that each of a pair of terminals is in contact with said conductive polymer thick film ink;

(d) applying at least one light emitting device to at least one selected portion of said surface, said at least one light emitting device positioned such that each of a pair of terminals is in contact with said conductive polymer thick film ink; and (e) curing said conductive polymer thick film ink.

25. The method of claim 24 wherein said dropping resistor is a surface mount resistor.

26. The method of claim 24 wherein said dropping resistor is a resistive polymer thick film ink applied to a selected region of the substrate with said resistive polymer thick film ink bridging a gap between two of said plurality of conductive traces.

27. A method of providing backlight illumination of an image with an illumination circuit formed on a substrate, said method comprising the steps of:

(a) applying an opaque border to said surface of the substrate;

(b) applying a conductive polymer thick film ink to a plurality of selected portions of a surface of the substrate, said conductive polymer thick film ink forming a plurality of conductive traces;

(c) applying at least one light emitting device to at least one selected portion of said surface, said at least one light emitting device positioned such that each of a pair of terminals is in contact with said conductive polymer thick film ink;

(d) applying a battery holder to the substrate, said battery holder having a pair of terminals in contact with said conductive polymer thick film ink; and (e) curing said conductive polymer thick film ink.

* * * * *